US005373565A

United States Patent [19]

Watanabe

[11] Patent Number: 5,373,565

[45] Date of Patent: Dec. 13, 1994

[54] SPACER FOR COAXIAL LOUDSPEAKERS

[75] Inventor: Shuichi Watanabe, Saitama, Japan

[73] Assignee: Pioneer Electronic Corporation, Tokyo, Japan

[21] Appl. No.: 133,780

[22] Filed: Oct. 8, 1993

Related U.S. Application Data

[63] Continuation of Ser. No. 861,741, Apr. 1, 1992, abandoned.

[30] Foreign Application Priority Data

Sep. 30, 1991 [JP] Japan ..... 3-278590

[51] Int. Cl.[5] ..... H04R 25/00

[52] U.S. Cl. ..... 38/182; 381/192; 381/199

[58] Field of Search ..... 381/194, 197, 158, 199, 381/201, 182, 186, 192, 188, 205; 181/144, 146, 151, 199

[56] References Cited

U.S. PATENT DOCUMENTS

| | | | |
|---|---|---|---|
| 2,295,527 | 9/1942 | Bowley | 381/158 |
| 2,426,948 | 9/1947 | Preston | 381/182 |
| 2,923,783 | 2/1960 | White | 381/197 |
| 3,424,873 | 1/1969 | Walsh | 381/204 |
| 3,796,839 | 3/1974 | Torn | 381/158 |
| 4,058,688 | 11/1977 | Nishimura et al. | 381/158 |
| 4,497,981 | 2/1985 | House | 381/182 |
| 4,552,242 | 11/1985 | Kashiwabara | 381/182 |
| 4,821,331 | 4/1989 | Murayama et al. | 381/182 |

FOREIGN PATENT DOCUMENTS

| | | | |
|---|---|---|---|
| 0084098 | 7/1981 | Japan | 381/158 |
| 0102196 | 8/1981 | Japan | 381/194 |
| 0114499 | 9/1981 | Japan | 381/197 |
| 0195796 | 8/1990 | Japan | 381/159 |

*Primary Examiner*—Curtis Kuntz
*Assistant Examiner*—Huyen D. Le
*Attorney, Agent, or Firm*—Nikaido, Marmelstein, Murray & Oram

[57] ABSTRACT

A spacer is provided for mounting a tweeter. The spacer has a resonator. The responator comprises a cavity formed in the spacer and a plurality of ports communicated with the cavity.

6 Claims, 15 Drawing Sheets

SPACER FOR COAXIAL LOUDSPEAKERS

This application is a continuation of application Ser. No. 07/861,741 filed Apr. 1, 1992, now abandoned.

BACKGROUND OF THE INVENTION

The present invention relates to a spacer which is disposed in a coaxial loudspeaker for mounting a speaker unit for a high audio frequency range and a middle audio frequency range.

A coaxial loudspeaker is a complex speaker comprising coaxially mounted two or more speaker units housed in a single frame, thereby providing a multiway loudspeaker. The coaxial speaker is compact in size so as to be preferably mounted on an automobile.

Referring to FIG. 17, a two-way coaxial loudspeaker comprises a woofer 9 and a mid-and high-range speaker unit 11 coaxially mounted on the woofer 9. The woofer 9 has a pole yoke 1 having an integral center pole 2, an annular magnet 3 mounted on the yoke 1, and an annular plate 4 mounted on the magnet 3, thereby forming a magnetic circuit. A conical frame 7 is mounted on the plate 4 through screws 8*a*. A conical diaphragm 8 is attached to the frame 7 around an upper edge thereof. A lower edge of the diaphragm 8 is connected to a damper 6 and a voice coil 5. A magnetic gap is formed between the center pole 2 of the yoke 1 and the plate 4. The voice coil 5 is supported by the damper 6.

On the center pole 2 is mounted a plastic spacer 10 through a screw 10*a*. The mid-and high range speaker unit 11 which forms an electromagnetic circuit comprising a voice coil (not shown), is mounted on the spacer 10. The coaxial loudspeaker is advantageous in that the construction thereof is simple, and that, since both of the speaker units 9 and 11 have the same sound source location, the sound image is stable.

However, in the loudspeaker employing the spacer, sound pressure levels increases in a mid-frequency range, specifically in a range between 1 and 5 KHz, thereby decreasing the sound quality.

More particularly, as shown in the graph of FIG. 18, the sound pressure levels of the speaker with the spacer, which is indicated by a solid line, increases at frequencies about 2 KHz, compared to that of a speaker without a spacer, which is shown by a dotted line. The cause of the increase is that the sound pressure increases in a space between the spacer 10 and the diaphragm 8 of the woofer 9, thereby raising the acoustic impedance thereof.

In order to solve the problem, the height of the spacer 10 is increased, and the outer diameter thereof is decreased as much as possible. However, the acoustic characteristics of the loudspeaker cannot be sufficiently improved just by adjusting the shape and the position of the spacer 10.

SUMMARY OF THE INVENTION

An object of the present invention is to provide a spacer for a coaxial loudspeaker where the deterioration of the sound quality is prevented.

In the coaxial loudspeaker, sound waves reflect in a space between the spacer and a diaphragm of a woofer. Various experiments using spacers of different shapes have shown that these reflections cause a rise of sound pressure level in a mid-frequency range which leads to an increase of acoustic impedance.

In order to find a solution for absorbing the reflections, an experiment where a spacer incorporating a Helmholtz's resonator was conducted. The results revealed that the resonator was an appropriate device for easily adjusting the resonant frequency. Furthermore, the resonance characteristics were easily adjusted by disposing an appropriate quantity of a sound absorbent in the resonator.

In accordance with the present invention, there is provided a spacer for a coaxial loudspeaker, wherein the spacer has a resonator.

In an aspect of the invention, a sound absorbent is provided in the resonator.

In another aspect of the invention, the resonator is divided into a plurality of portions, each of which has a different resonant frequency from others.

The spacer according to the present invention has a resonator which comprises a cavity and a plurality of ports communicated with the cavity. By adjusting the volume of the cavity and the dimensions and the number of the ports, the resonant frequency can be controlled.

When the sound absorbent is disposed in the resonator, the Q-value thereof can be controlled.

With the divided resonator, sound waves of different frequencies are absorbed so that the sound pressure levels can be decreased in a wide range of frequency.

The other objects and features of this invention will become understood from the following description with reference to the accompanying drawings.

DETAILED DESCRIPTION OF THE PREFERRED EMBODIMENTS

Figure 1:
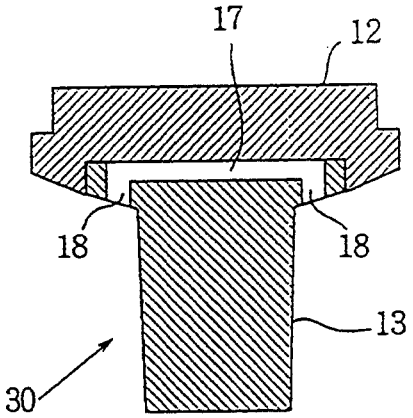
FIG. 1 is a sectional view of a spacer of a coaxial loudspeaker according to the present invention.
Figure 2:
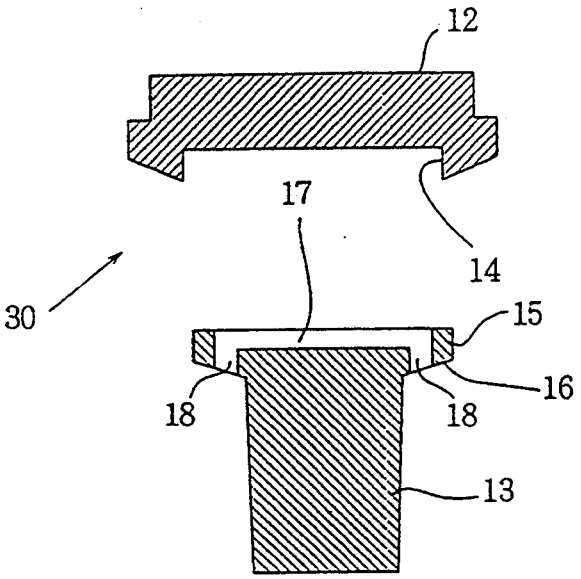
FIG. 2 is an exploded sectional view of the spacer of FIG. 1.
Figure 17:
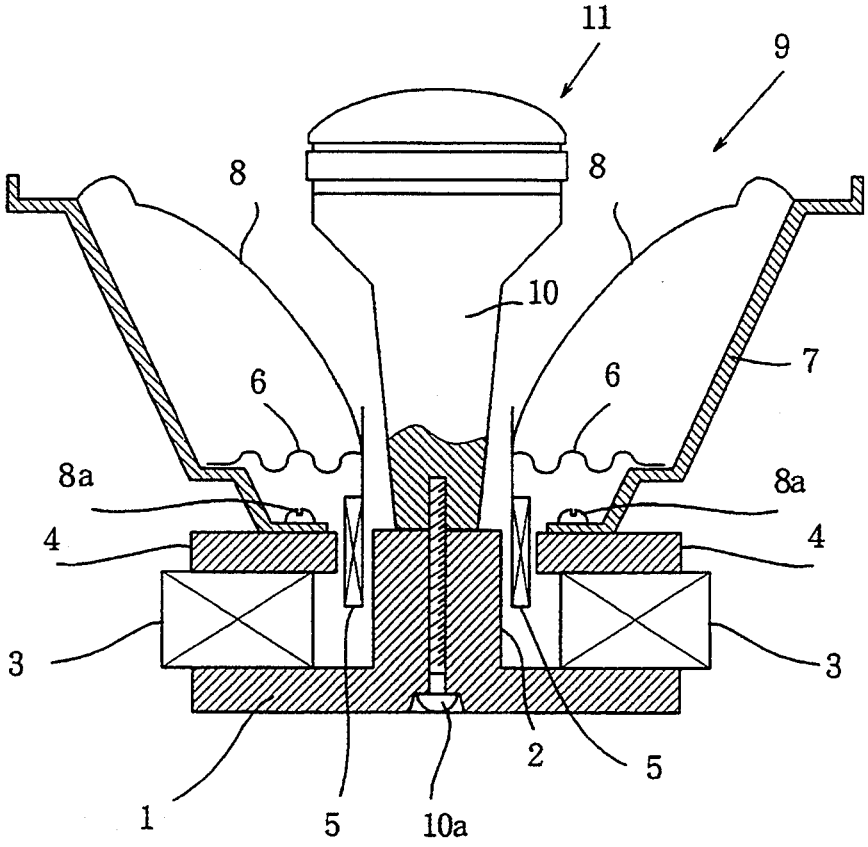
FIG.17 PRIOR ART
FIG. 17 is a sectional view of a conventional two-way coaxial loudspeaker.
Figure 18:
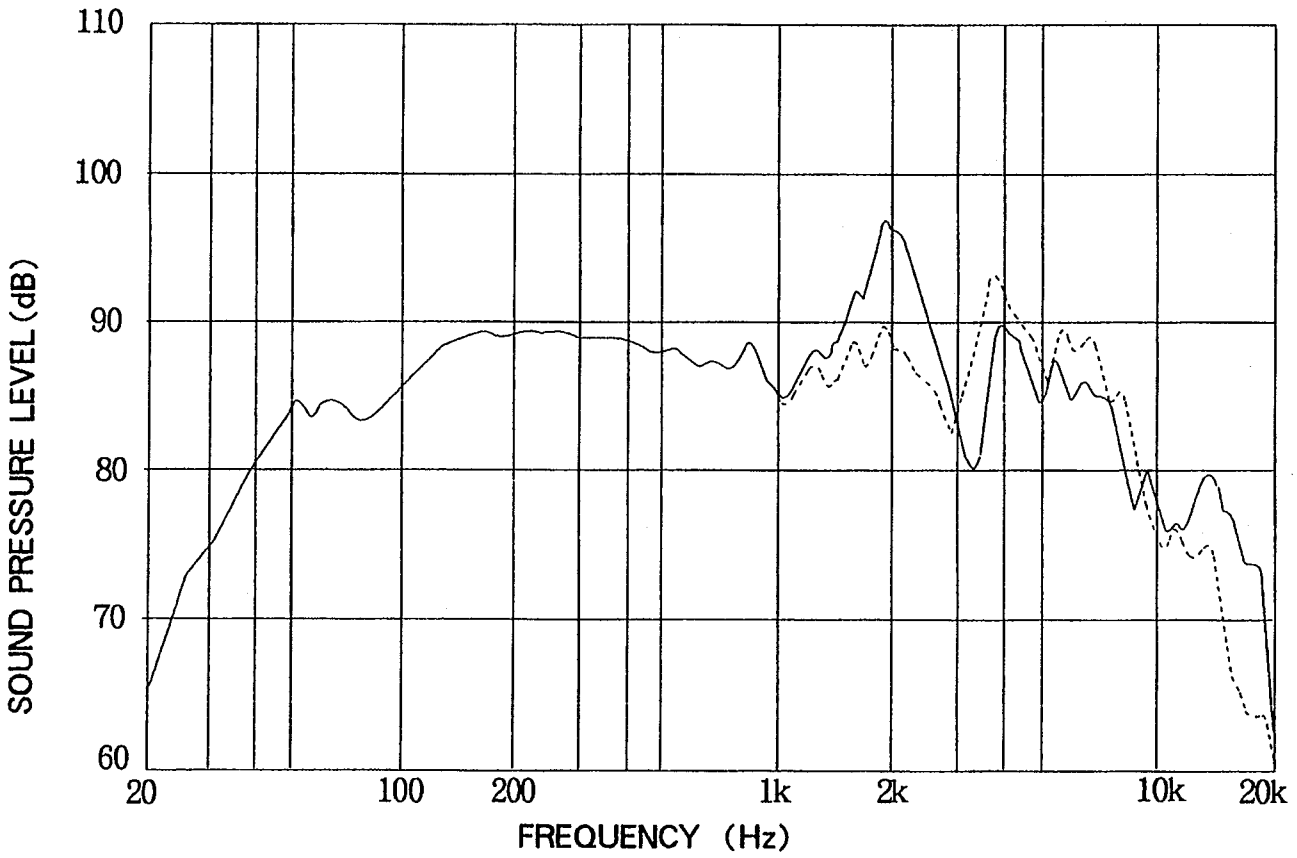
FIG.18 PRIOR ART
FIG. 18 is a graph showing a frequency response of the speaker of FIG. 17.

Referring to FIGS. 1 and 2, a spacer 30 adapted to be mounted on the conventional coaxial loudspeaker shown in FIG. 17 comprises a head 12 and a body 13.

Figure 3:
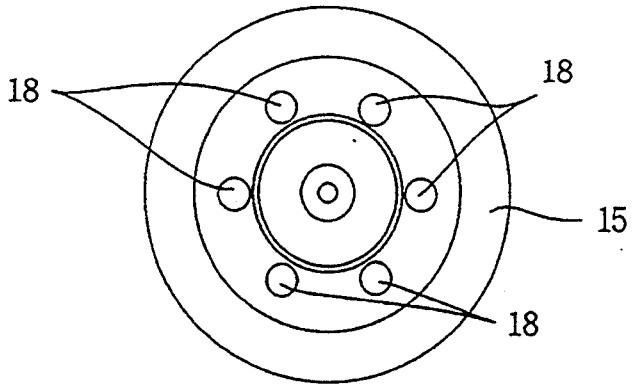
FIG. 3 is a diagram of the spacer of FIG. 1 as viewed from the underside thereof.

The head 12 has a bottom recess 14 in which an upper portion 15 of the body 13 is inserted. The upper portion 15 has a cavity 17, thereby forming a flange 16 around the periphery thereof. The cavity 17 is communicated with six ports 18 which are annularly arranged in the upper portion 15 as shown in FIG. 3. The number of the ports 18 may be less than five or more than seven. Upon assemblage of the spacer, the upper end portion 15 of the body 13 is engaged with the recess 14 of the head 12 and fixed thereto by an adhesive, so that a space is formed in the spacer 30 between the head 12 and the body 13. The cavity 17 and the ports 18 communicated with the cavity 17 thus form a Helmholtz's resonator for absorbing sound waves reflecting in the space between the spacer 30 and the diaphragm 8 of the woofer 9 shown in FIG. 17.

Figure 4:
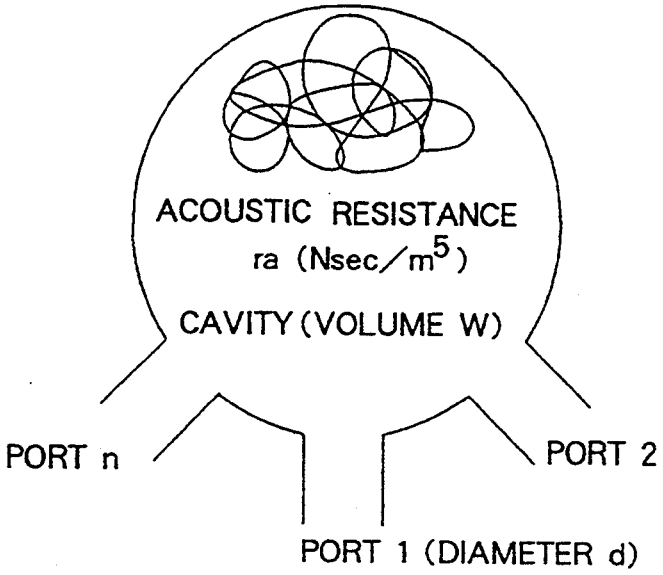
FIG. 4 is a diagram conceptually showing a model resonator formed in the spacer of FIG. 1.

The resonation of the spacer 30 is described hereinafter with reference to FIG. 4 showing a model resonator. In the model resonator, an acoustic capacitance Ca ($m^5/N$) of the cavity 17 is expressed as $$CA = W/(C^2\rho 0)$$

where W is a volume of the cavity 17, C is a sound velocity (m/sec) and p0 is an air density ($Kg/m^3$). An inertance Mp of the port 18 is expressed as $$Mp = \rho 0/Sp^2(Sp \times 1 + 2 \times (8/3) \times (d/2)^3)$$

where Sp and d are the sectional area ($m^2$) and the diameter of the port 18, respectively. The first term in the parentheses relates to the air mass in the port 18, and the second term is an additional term relative to the air mass at the outlet of the port 18.

When the spacer 30 is provided with n ports 18 having the same dimensions, a parallel resonant circuit is formed. An effective inertance M ($Kg/m^4$) of the circuit is expressed as $$M = Mp/n$$

Thus, the resonant frequency fr (Hz) of the resonator is expressed as $$fr = 1/2\pi \sqrt{1/MCa} \quad (1)$$

The Q-value Q is expressed as $$Q = 1/ra \sqrt{M/Ca} \quad (2)$$

where ra is an acoustic resistance.

Hence, by providing a resonator which absorbs sound waves having a frequency equal to the resonant frequency fr obtained by the equation (1), the elevation of the sound pressure levels in a mid-frequency range can be restrained.

Figure 5:
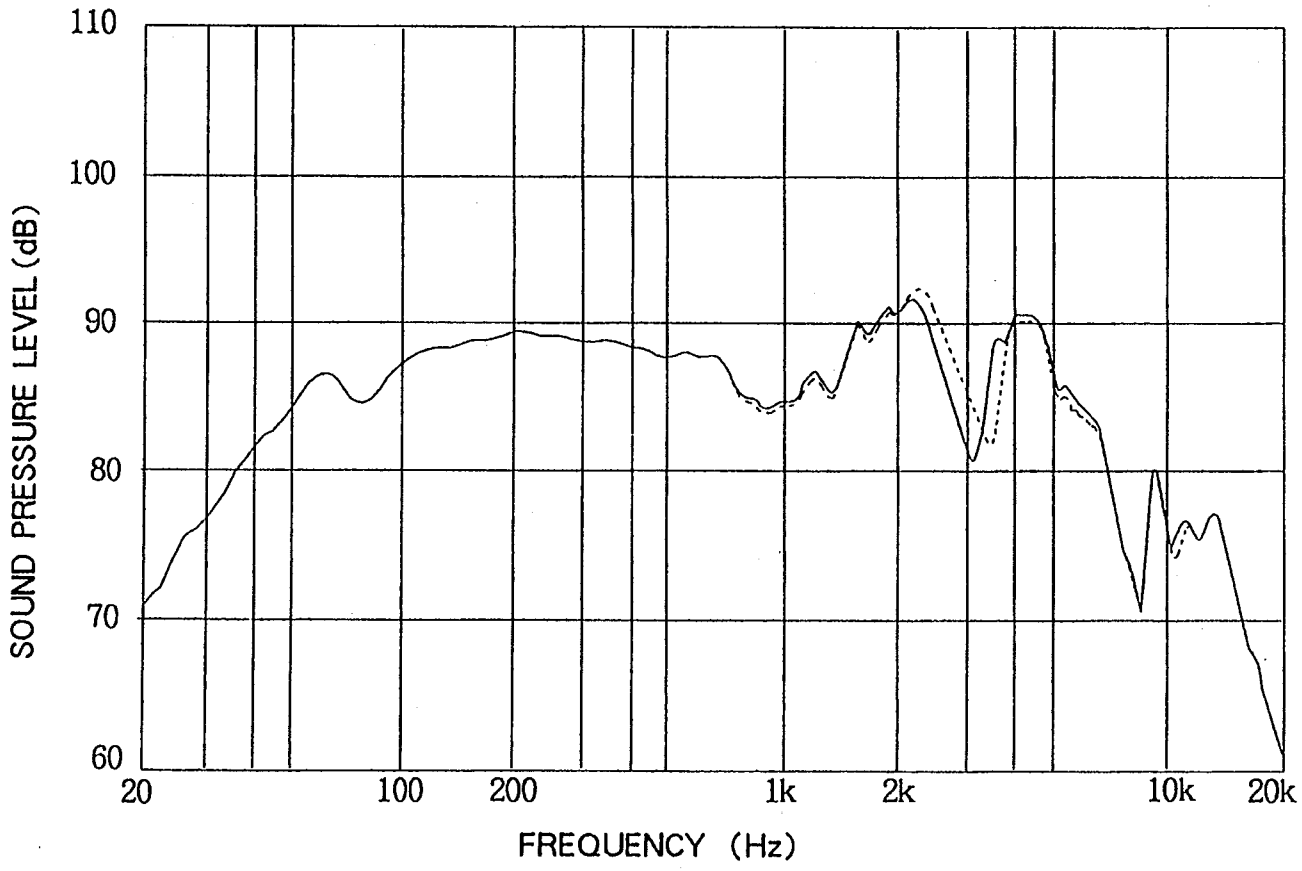
FIG. 5 is a graph showing a frequency response of the coaxial loudspeaker provided with the spacer of FIG. 1.
Figure 6:
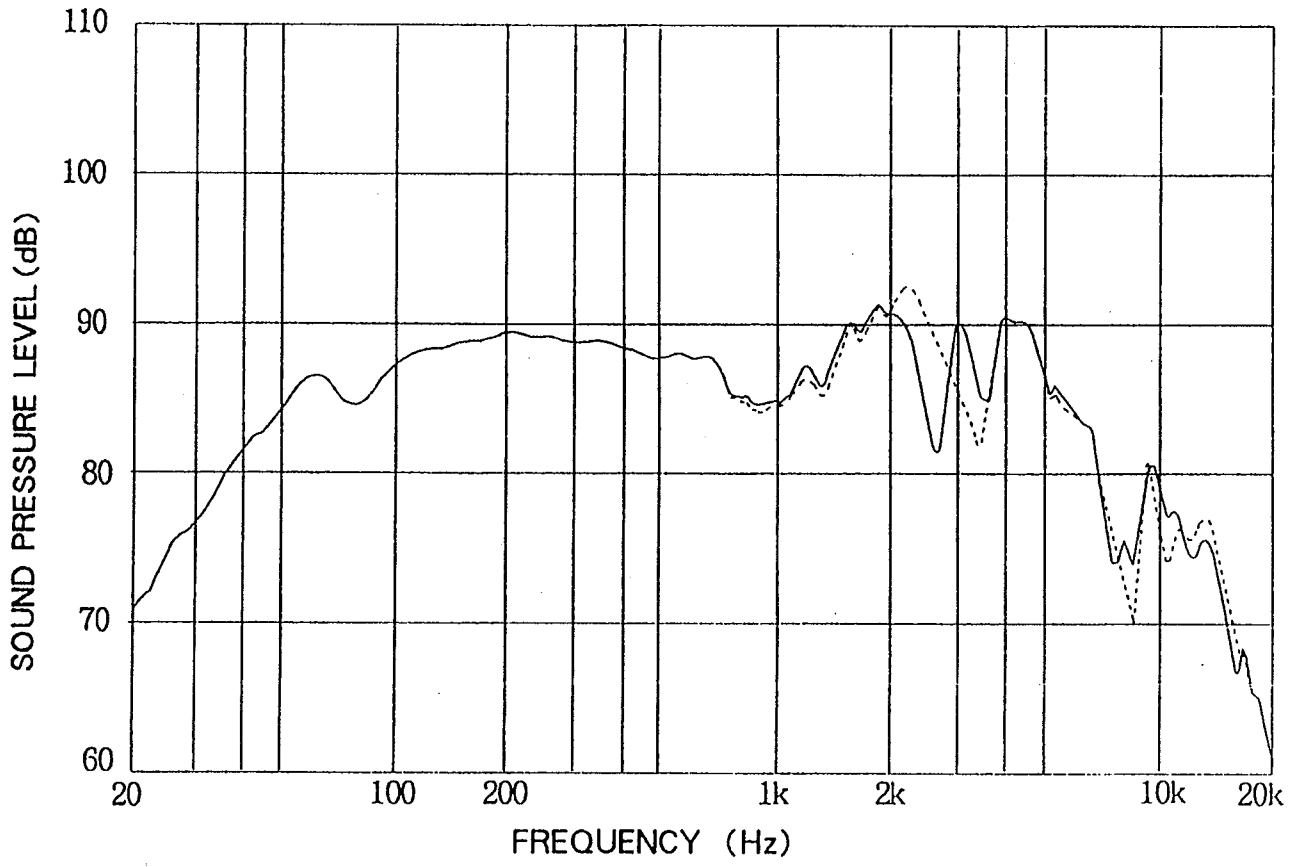
FIG. 6 is a graph showing a frequency response of a coaxial speaker provided with a modification of the spacer of FIG. 1.

FIG. 5 is a graph showing the frequency response of the coaxial loudspeaker wherein the spacer 30 is mounted. The dotted line in the graph indicates the frequency response of a coaxial loudspeaker having a conventional spacer without the cavity 17 nor the ports 18. As shown in the graph, the sound pressure levels in frequencies about 2 KHz is restrained compared to the sound pressure levels raised by the conventional spacer.

If the resonator is disposed adjacent the diaphragm 8 of the woofer 9, the sound waves having frequencies near the resonant frequency thereof which are propagated adjacent the resonator is affected in phase and amplitude. On the other hand, the sound waves far away from the resonator are not affected. Accordingly, the sound waves interfere with each other so that, when the waves are in opposite phase, the sound pressure level is decreased, and when inphase, increased.

In accordance with the equation (1), there are several ways of lowering the resonant frequency fr of the resonator. Namely, the volume W and hence the acoustic capacitance Ca of the cavity 17 is increased. Another method is to increase the inertance Mp of the port 18, that is, to increase the length of the port 18, or to decrease the sectional area Sp thereof. The resonant frequency fr can be increased by the contrary methods. However, supposing that the acoustic resistance ra of the cavity 17 is constant, when the volume W of the cavity 17 is increased, the Q-value is decreased as apparent from the equation (2). On the contrary, if the inertance of the port 18 is increased, the Q-value increases. Thus, when controlling the resonance frequency of the resonator, the change of the Q-value must be noted in determining whether to change the volume of the cavity 17 or the dimensions of the port 18.

In order to change the Q-value without changing the resonant frequency of the resonator, a sound absorbent, the quantity of which can be varied is disposed in the cavity 17. Alternatively, the volume of the cavity 17 and the dimensions of the ports 18 are both changed.

Various examples of the spacer 30 providing the resonator are described hereinafter with reference to FIGS. 6 to 14. It should be noted that in each graphs of FIG. 6 and FIG. 8 to 14 the dotted line shows the frequency response of the coaxial loudspeaker having the conventional spacer.

The volume W of the cavity 17 is increased to lower the resonance frequency fr. It can be understood from the graph of FIG. 6 that, similar to the spacer of FIG. 1, the resonance caused by the resonator improves the frequency response of the speaker.

Figure 7:
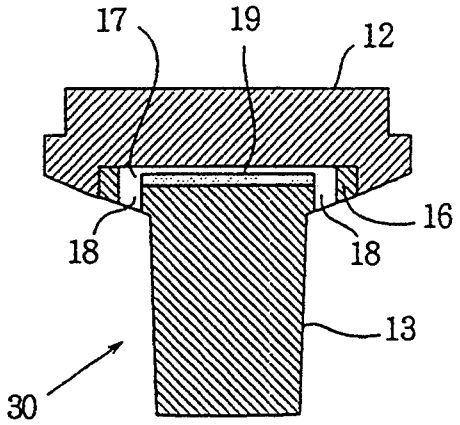
FIG. 7 is a sectional view of another modification of the spacer of the present invention.
Figure 8:
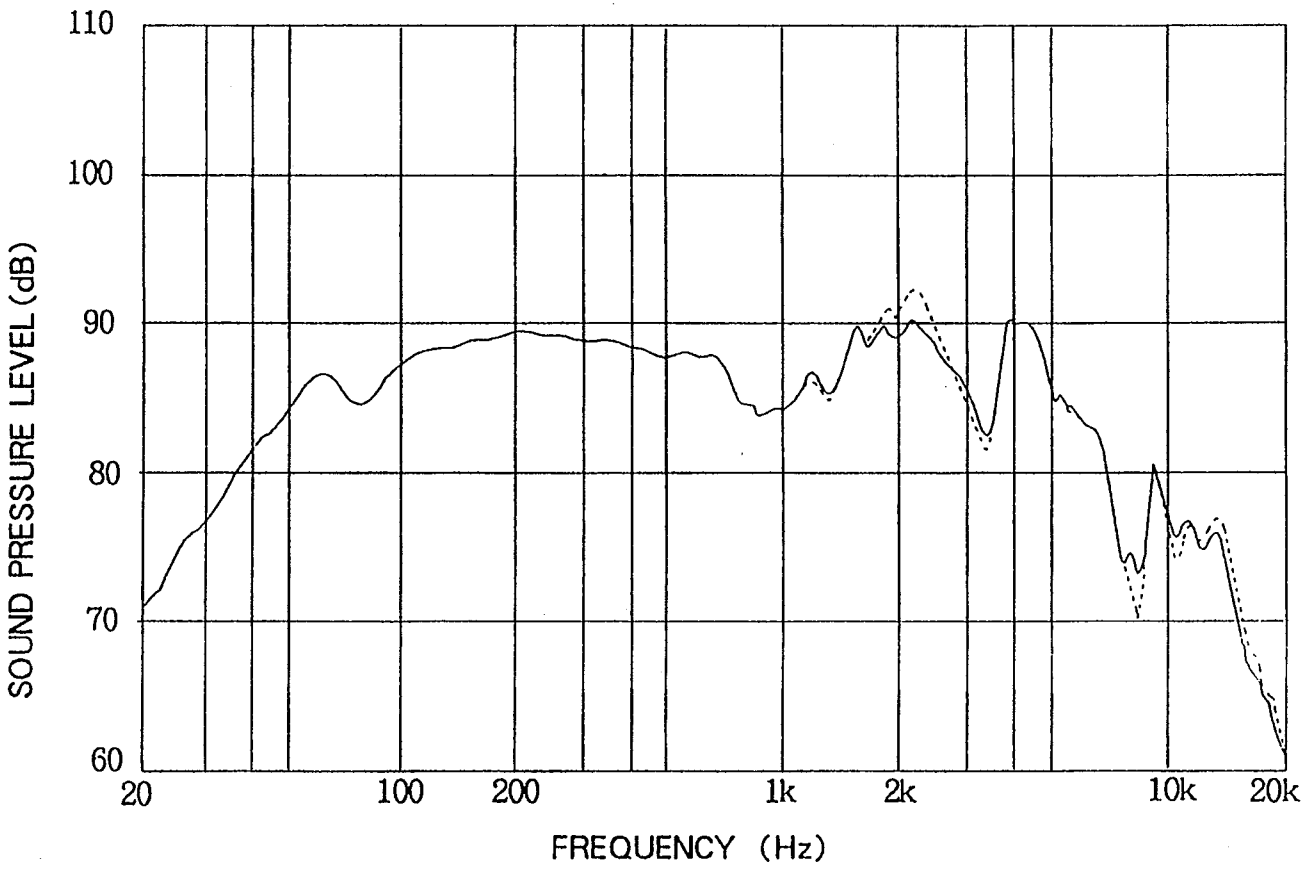
FIG. 8 is a graph showing a frequency response of a coaxial loudspeaker provided with the spacer of FIG. 7.

Referring to FIG. 7, a large quantity of a sound absorbent 19 is disposed in the cavity 17. As shown in FIG. 8, the elevation of the sound pressure levels in the frequencies about 2 KHz is further restrained, thereby improving the sound quality. The Q-value is decreased so that the sound waves of substantially the same frequency are absorbed by the spacer 30.

Figure 9:
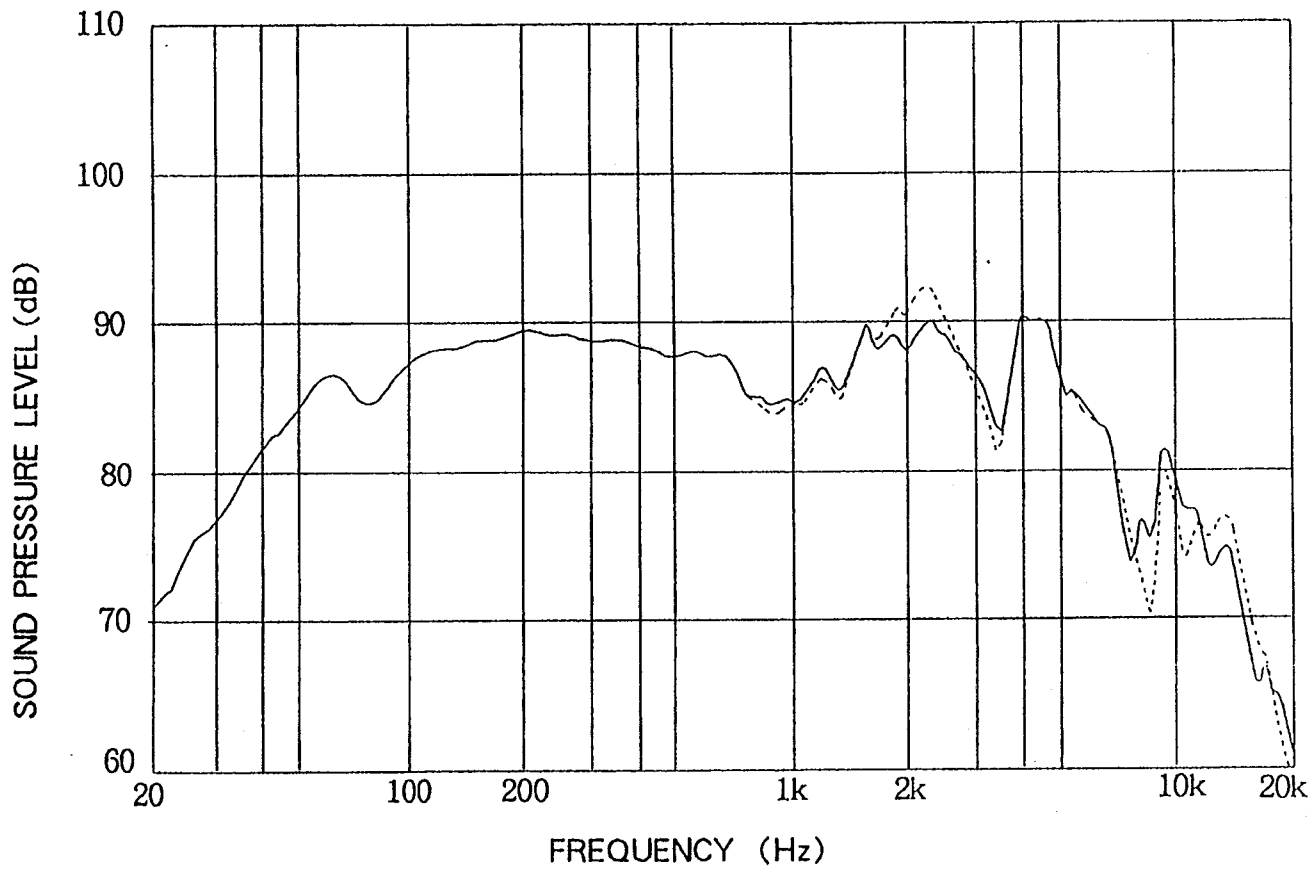
FIGS. 9 to 14 are graphs each showing a frequency response of a coaxial speaker provided with an example of the spacer of FIG. 7.

FIG. 9 shows the frequency response when the volume of the cavity 17 in which the large quantity of sound absorbent 19 is provided is increased in order to lower the resonant frequency. Comparing the graph with the graph of FIG. 8, the increase of the cavity volume seems to have little influence on the resonant frequency if a large quantity of sound absorbent is used.

Figure 10:
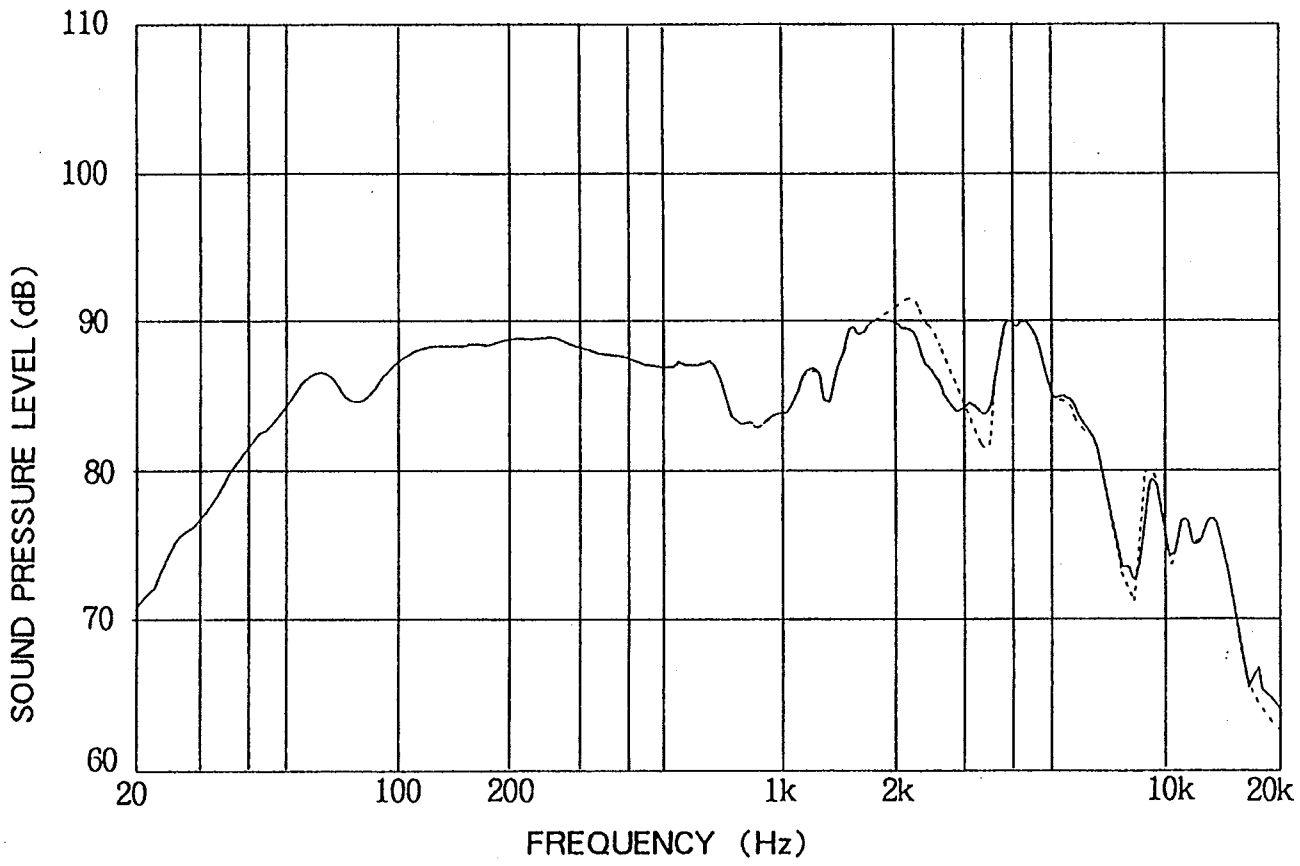

The change in frequency response of the speaker in accordance with the quantity of the sound absorbent is explained hereinafter. Referring to FIG. 10, when the sound absorbent 19 in the cavity 17 is decreased to one-third of that shown in FIG. 7, the sound pressure levels near the frequency 2 KHz are restrained from increasing, so that the frequency response is flat. The Q-value is increased so that the quantity of sound absorption is increased. At the same time, the emanation of sounds is also increased.

Figure 11:
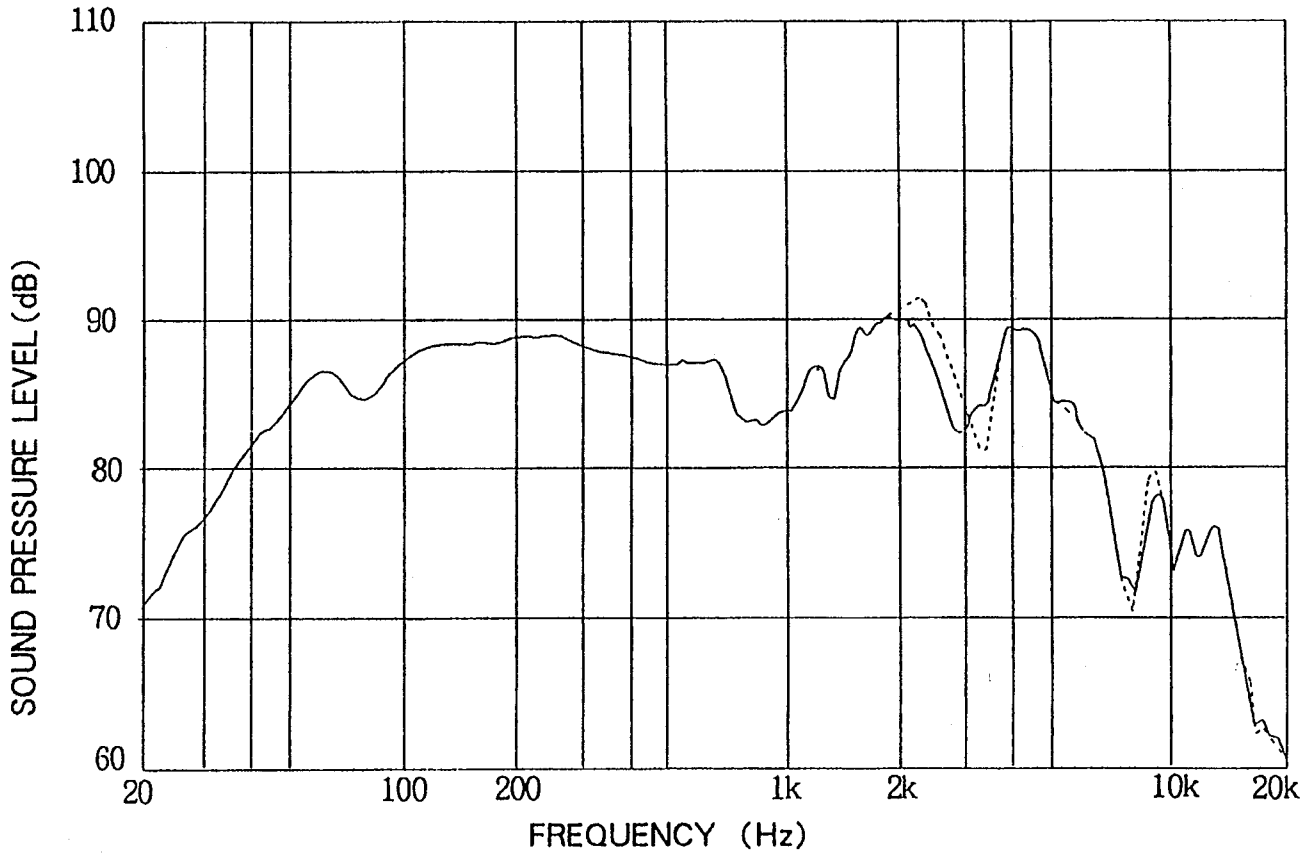

FIG. 11 shows a frequency response of a speaker, the spacer 30 of which has the cavity 17 with the absorbent 19 in a quantity one-fourth of that shown in FIG. 7. The Q-value is further increased in the example.

When the quantity of the absorbent 19 in the cavity 17 is further decreased to one-eighth of that of FIG. 7, the Q-value is further increased so as to approximate the frequency response of a speaker provided with the resonator without the sound absorbent 19. Namely, by decreasing the quantity of the sound absorbent without changing the volume of the cavity 17, the Q-value may be increased.

Figure 12:
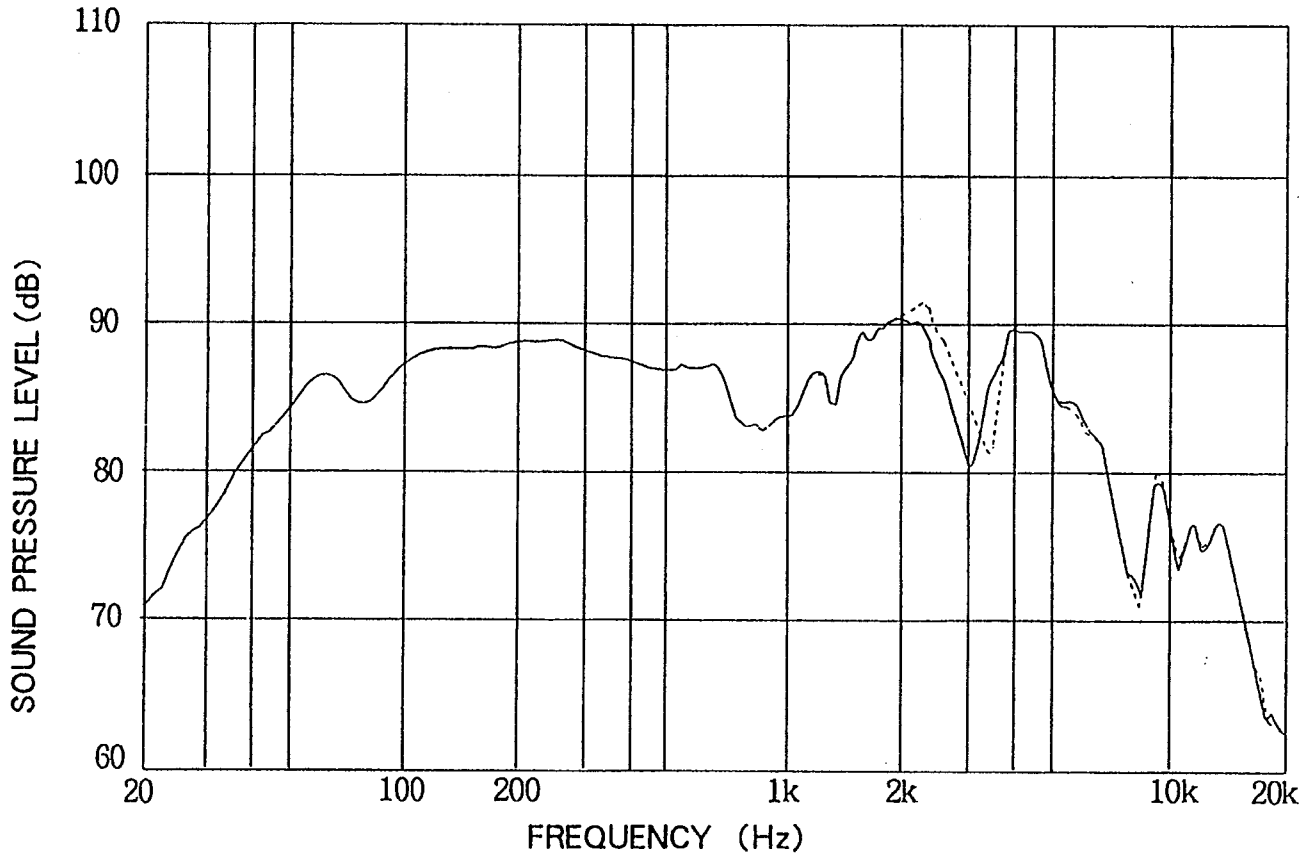
Figure 13:
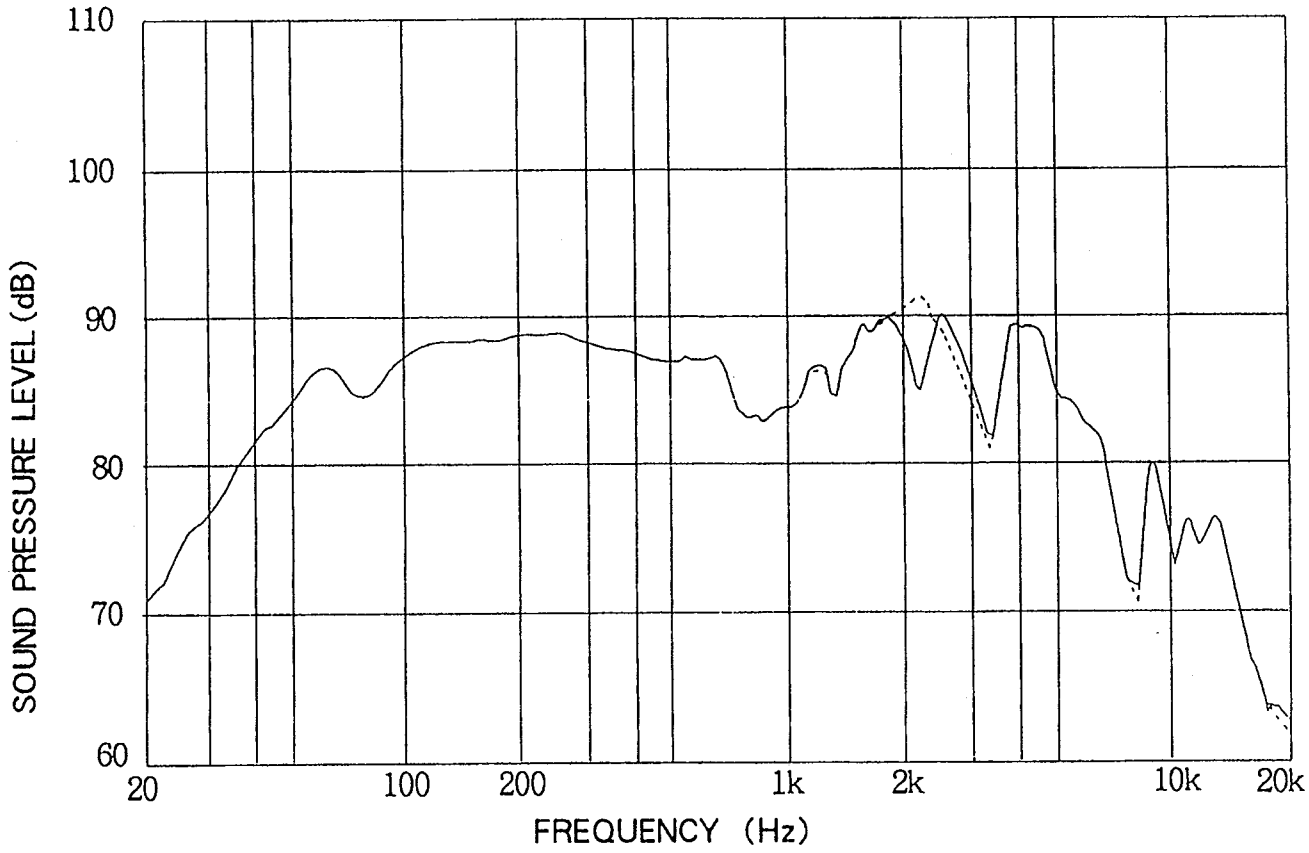

In a speaker provided with a spacer having only three ports 18 and the absorbent 19 in the quantity same as in the example of the spacer associated with FIG. 12, the resonant frequency is lowered without decreasing the volume of the cavity 17 as shown in FIG. 13.

Figure 14:
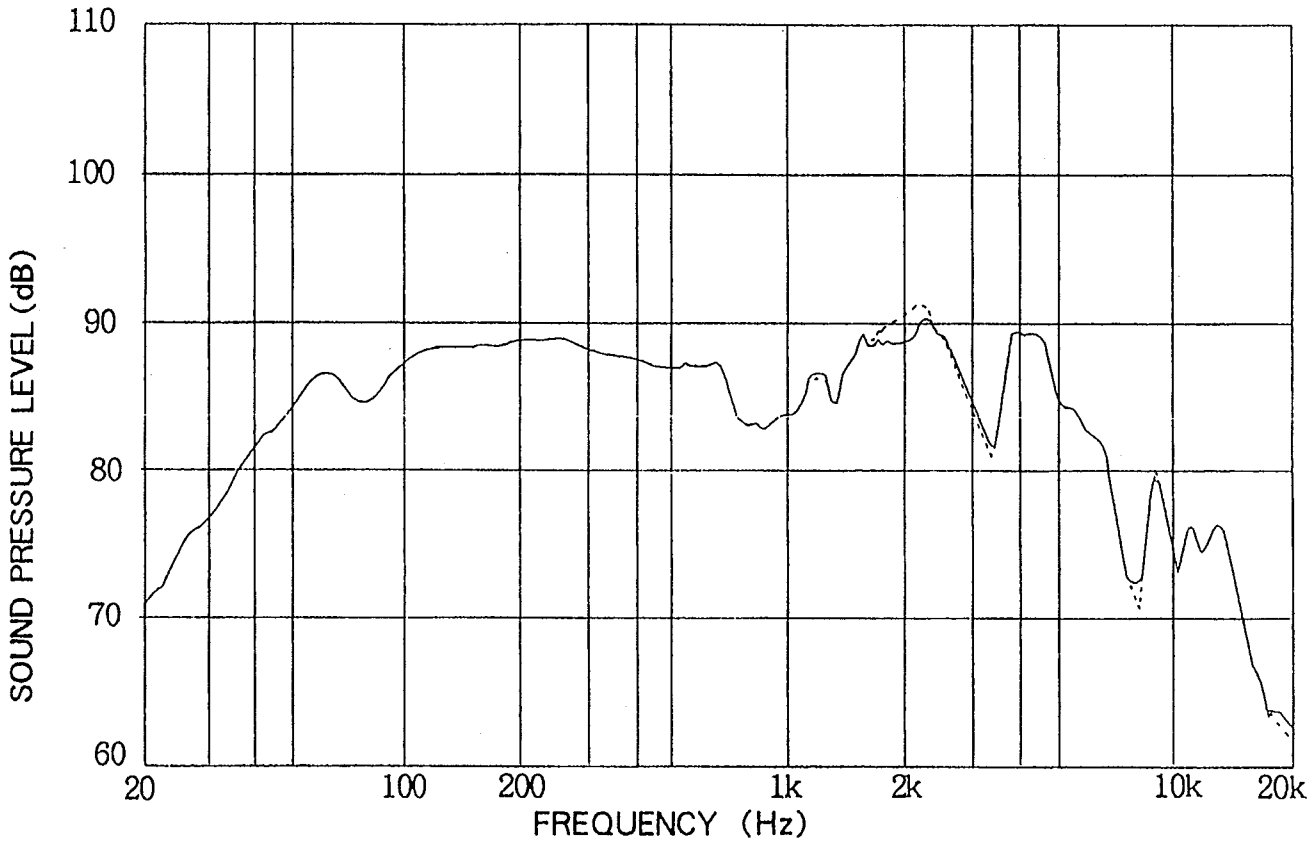

FIG. 14 shows a frequency response of a speaker, the resonator of which is similar to that associated with FIG. 13 expect that the quantity of the sound absorbent 19 is increased to one-third of that shown in FIG. 7 instead of one-eighth. Although the resonant frequency stays unchanged from that of FIG. 13, the Q-value is decreased. Namely, as apparent from FIGS. 13 and 14, the resonant frequency may be easily controlled by changing the number of ports 18 and the Q-value may be easily controlled by changing the quantity of the sound absorbent 19.

Figure 15:
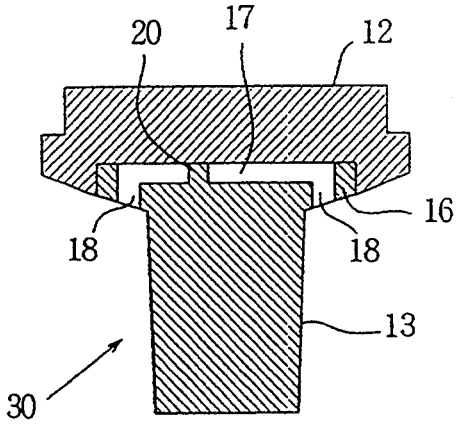
FIG. 15 is a sectional view of a spacer as a second embodiment of the present invention.

Referring to FIG. 15, showing the second embodiment of the present invention, a baffle 20 is integrally formed on the body 13 of the spacer 30 to divide the cavity 17 into two portions, thereby providing two resonators in the spacer 30. Each resonator has a resonant frequency different from that of the other so that the sound pressure levels may be controlled in a wide range of frequency.

Figure 16:
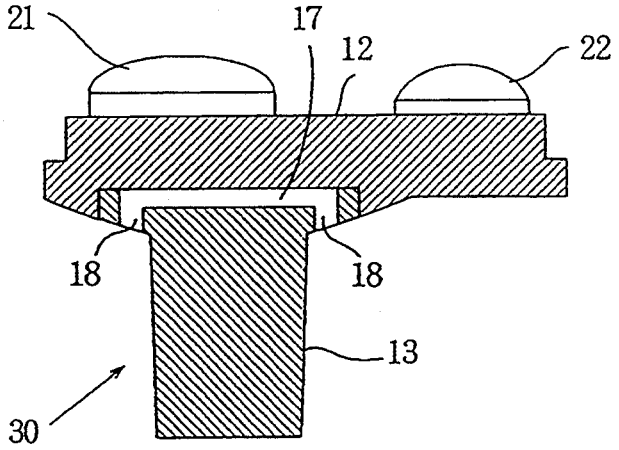
FIG. 16 is a sectional view of a spacer of a three-way coaxial loudspeaker as a third embodiment of the present invention.

FIG. 16 shows the spacer 30 of the present invention applied to a three-way coaxial loudspeaker which has a mid-range speaker unit 21 and a tweeter 22 mounted on the extended head 12.

From the foregoing it will be understood that the present invention provides a spacer for a coaxial speaker having a resonator wherein the increase of sound pressure levels in a mid-frequency range is restrained to improve the quality of sounds reproduced by the speaker. By changing the volume of a cavity of the resonator and/or the shape and the number of ports thereof, the resonant frequency can be easily controlled. The Q-value of the resonator can be also controlled by providing a sound absorbent in the cavity and changing the quantity thereof. If the cavity is divided into plurality of portions each corresponding to a resonator having a specific resonant frequency, the sound pressure levels can be restrained in a wide range of frequency. Since only a small quantity of absorbent is necessary, the device is preferable from the points of manufacturing cost and of mass-production.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A spacer for mounting a speaker of a higher audio frequency range within a speaker for a lower frequency range, comprising:

a support portion supporting the higher audio frequency speaker;

an elevation portion attached to a bottom of said support portion, said elevation portion for elevating said support portion; and a resonator, said resonator comprising a cavity formed between said support portion and said elevation portion, with a plurality of ports for communicating said cavity with an outside space, each of said ports being downwardly opened.

2. A spacer according to claim 1 further comprising a sound absorbent provided in the cavity.

3. A spacer according to claim 1 wherein the cavity is divided into a plurality of portions, each of which has a different resonant frequency from those of other portions.

4. A loudspeaker, comprising:

first speaker means for reproducing low-frequency audio signal, said first speaker means having a cone portion;

second speaker means for producing higher frequency audio signal than said first speaker means, said second speaker means disposed within said cone portion;

spacer means disposed for mounting said second speaker means within said cone portion, said spacer means including an elevation body for elevating said second speaker means from a bottom portion of said cone portion, a flange, and a head secured to said flange for supporting said second speaker means, and a resonator comprising a cavity formed in an area of said spacer means between said elevation body and said head, said resonator having a plurality of ports for communicating said cavity with an outside space between the spacer means and the cone portion, each of said ports being downwardly opened.

5. A loudspeaker as recited in claim 4, further comprising a sound absorbent provided in said cavity.

6. A loudspeaker as recited in claim 4, wherein the cavity is divided into a plurality of portions, each of which has a different resonant frequency from those of other portions.

* * * * *